US007025351B2

(12) United States Patent
Christensen

(10) Patent No.: US 7,025,351 B2
(45) Date of Patent: Apr. 11, 2006

(54) PUZZLE GAME

(76) Inventor: Russell Zelany Christensen, 79 Bridge St, Eltham (NZ)

( * ) Notice: Subject to any disclaimer, the term of this patent is extended or adjusted under 35 U.S.C. 154(b) by 0 days.

(21) Appl. No.: 10/601,640

(22) Filed: Jun. 24, 2003

(65) Prior Publication Data

US 2004/0046318 A1 Mar. 11, 2004

(30) Foreign Application Priority Data

Jun. 28, 2002 (NZ) ..... 519834

(51) Int. Cl.
*A63F 9/08* (2006.01)

(52) U.S. Cl. ..... 273/153 S; 273/156

(58) Field of Classification Search ..... 273/155, 273/153 S, 156
See application file for complete search history.

(56) References Cited

U.S. PATENT DOCUMENTS

| | | | | |
|---|---|---|---|---|
| 2,591,303 | A * | 4/1952 | Schriner et al. | 273/156 |
| 4,357,016 | A * | 11/1982 | Allison | 273/156 |
| 4,632,399 | A * | 12/1986 | Bern | 273/155 |
| 4,836,540 | A * | 6/1989 | Bean | 273/155 |
| 5,148,692 | A * | 9/1992 | Gieseker | 273/156 |

* cited by examiner

*Primary Examiner*—Steven Wong

(57) ABSTRACT

A puzzle game is disclosed in which a mechanical puzzle is contrived from a set of components, the game including a deconstruction of the puzzle's form. In randomizing and solving the puzzle, a handle and a housing are alternately rotated about and translated along an axis in relation to each other. Deconstruction of the puzzle's form involves removing a core sub-assembly containing the handle and other demountable components. This facilitates access to the housing.

10 Claims, 4 Drawing Sheets

PUZZLE GAME

CROSS-REFERENCE TO RELATED APPLICATIONS

Application number 512613 was filed in New Zealand for substantially the same invention on Jun. 27, 2001. This application was deemed abandoned when the Intellectual Property Office of New Zealand took action on Jun. 25, 2002, after a letter dated Jun. 21, 2002 willing abandonment was received from the inventor. Subsequently on Jun. 28, 2002, application number 519834 was filed in New Zealand. Priority is claimed under the Paris Convention for this later filing.

BACKGROUND OF THE INVENTION

This invention is means for and a method of playing a game which develops the subject matter of U.S. Pat. No. 4,632,399.

An apparatus for making rotational mechanical puzzles is depicted in FIGS. 8, 9, 10, 11 and 12 of U.S. Pat. No. 4,632,399. According to the known art, a set of puzzle components can be assembled in a large variety of different ways. The assemblage once complete and randomised prevents the user from disassembling the apparatus until the puzzle it makes has been solved. Both the process of randomisation and the process of solution require torque to be selectively applied to certain coaxial annular elements in the apparatus.

BRIEF SUMMARY OF THE INVENTION

The current invention develops the known art apparatus by including a housing wherein a small extraneous object may be stored. Release of the object from the housing is prevented until the apparatus is disassembled. As mentioned above, this may require a puzzle to be solved.

The invention further develops the known art apparatus by the provision of a fastening device adapted to prevent toddlers from having access to the small projectional units in the core.

In accordance with the known art, said core comprises two long rigid members and a sequence of small projectional units. The known art core is held together by the action of a semi-tubular limiter upon which annular elements are rotatably mounted to interact with the projectional units. However when the known art core is removed from the limiter, the long rigid members readily separate and the small projectional units fall out.

In a game context, in accordance with the invention, a first player may be challenged to solve a puzzle by a second player. In this context, removal of the core is a dramatic expression available to the first player, when and only when they have solved the puzzle, to indicate their triumph and optionally to draw attention to the ensuing release of the extraneous object from the housing. The aforementioned fastening device ensures that this dramatic expression is not accompanied by spillage of small projectional units from the core.

Thus the invention provides a novel means of interaction for parent and child according to which the parent, being the second player above-mentioned, can challenge the child with puzzles of various degrees of difficulty and, in each case, leave the child unwatched to solve the puzzle and extract the core if they are able.

Indeed it is an object of the invention to provide a colourful plastic contrivance that is attractive to potential users of all age groups from 18 months old, which may therefore come into a household as a uniquely valuable educational game.

It is a further object of the invention to provide a puzzle means which can be assembled to form puzzles of various degrees of difficulty. In the preferred embodiment, the invention further develops the known art apparatus in this regard by forming said housing from two separable pieces, one piece functioning as a container and the other as a lid for the container. Said lid is preferably formed during its manufacture so that when attached to said container it occupies a whole number multiple of the longitudinal extent of any one of said elements on the limiter. When the apparatus is assembled without the lid, additional annular elements may be supplied to replace the lid on the limiter. The latitudes provided to permit rotation of said elements on the limiter will then be preserved as said additional elements will take up exactly the same space longitudinally on the limiter as the lid would have done. At the same time, the difficulty level of puzzles made with the apparatus will increase.

These and other aspects of the invention are illustrated in the drawings as hereinafter outlined wherein FIGS. 1–7 show various parts of a first apparatus and FIGS. 8–9 show a second apparatus in accordance with the invention.

BRIEF DESCRIPTION OF THE SEVERAL VIEWS OF THE DRAWING

FIG. 3 shows the catch part just prior to its engagement during the process of assembling the core. FIG. 4 shows the catch part afterward as it secures the core by trapping a bent portion 114 of the molded plastic spindle 112. FIGS. 3 and 4 show one end only of the core using the same plane of cross-section.

In FIG. 6, handle 99 is shown detached from the core.

DETAILED DESCRIPTION OF THE INVENTION

Figure 1:
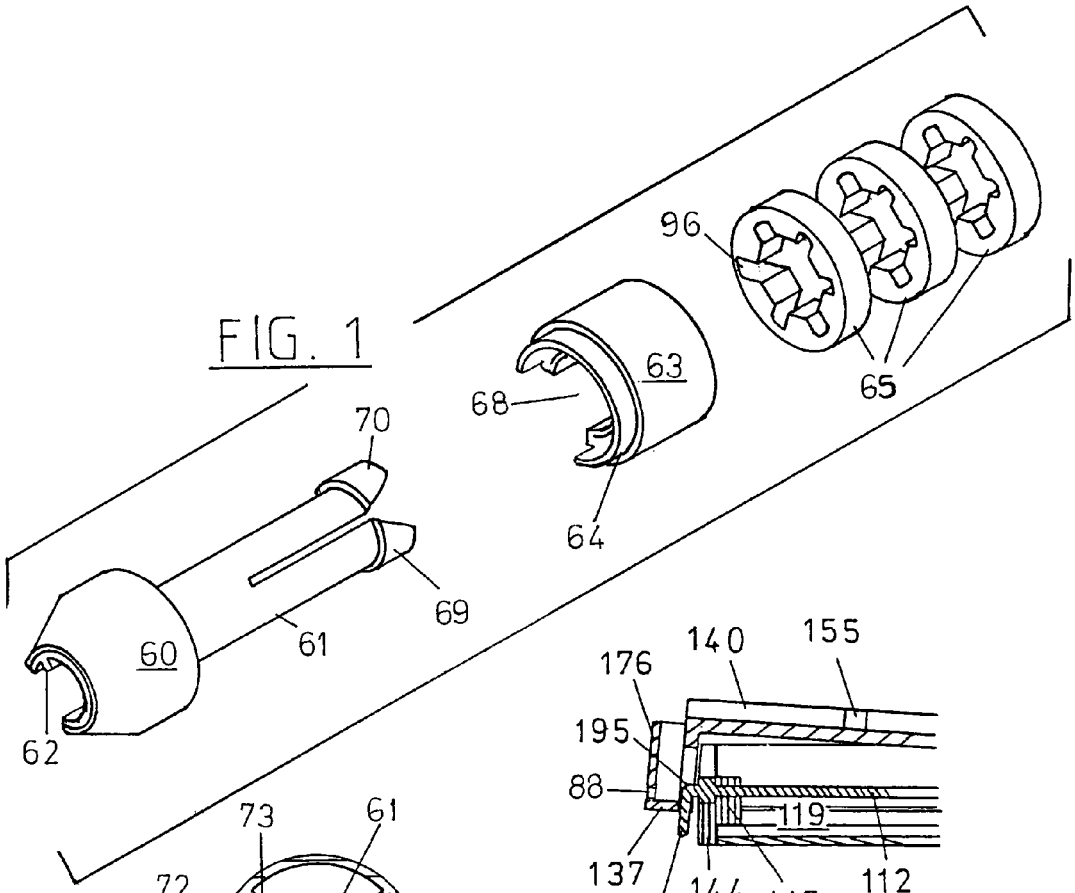
FIG. 1 is an exploded isometric view of a semi-tubular limiter showing also the attached container 60, lid 63 and annular elements 65*s*. Container 60 and lid 63 are adapted to define a storage space for a small piece of paper. Thus lid 63 closes the storage space at its end proximate the elements 65, preventing the paper from being extracted until elements 65*s* are demounted from the limiter.
Figure 2:
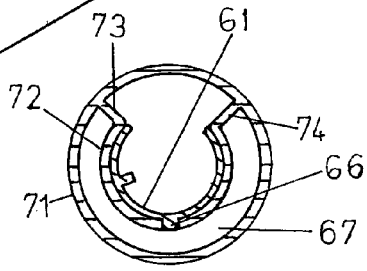
FIG. 2 is a cross-section through container 60 in a plane perpendicular to the axis of rotation showing a boss 66 which fixes the container on the limiter.

With reference to FIG. 1, congruent annular elements 65*s* are employed in said first apparatus, each with six equally spaced interior keyways including one keyway larger than the rest. A semi-tubular limiter 61 is bifurcated at one end whereby the lips 69, 70 at that end may be pressed together to facilitate the mounting of said annular elements on 61. At the other end of 61, container 60 is secured.

Container 60 includes a curved interior wall 72, a curved exterior wall 71 and flat side walls 73, 74 whereby it defines a cavity 67 sealed at one end. Interior wall 72 subtends 270 degrees only in a plane orthogonal to the axis of rotation. Elements 65*s* may be rotated on limiter 61 about this axis. At the sealed end, wall 71 slopes toward said axis to meet wall 72.

Whereas limiter 61 presents an equable convex surface as an arbor for elements 65*s*, this surface is extended in abutment with said interior wall 72 for the length of container 60. Protruding boss 66 molded into said surface is tightly accommodated in a recess defined by wall 72. By this means container 60 and limiter 61 form an integrated whole which the end user of the apparatus is not invited to disassemble. Additional attachment means such as glue may be employed to completely secure 60 to 61.

At the open end of cavity 67 sufficient space is provided on said arbor for seven elements 65*s*. When all seven are accommodated on limiter 61 (without lid 63) walls 72 and 71 form annular stops which cooperate with the lips 69, 70 at the other end of the limiter to confine the elements 65*s* in preparedness for their use in a puzzle to be made with the apparatus. General principles concerning the operation of the puzzle are described in U.S. Pat. No. 4,632,399 with reference especially to FIGS. 8–12.

By way of an alternative mode of construction, the user may choose to deploy lid 63 on limiter 61 instead of a certain number of the elements 65*s*. By reducing the number of elements 65*s* in the puzzle, the user may construct a simpler puzzle. Preferably lid 63 replaces three only elements 65*s*, although it may replace four as I have suggested in FIG. 1 or some other number as would be clear to those skilled in the art.

Figure 7:
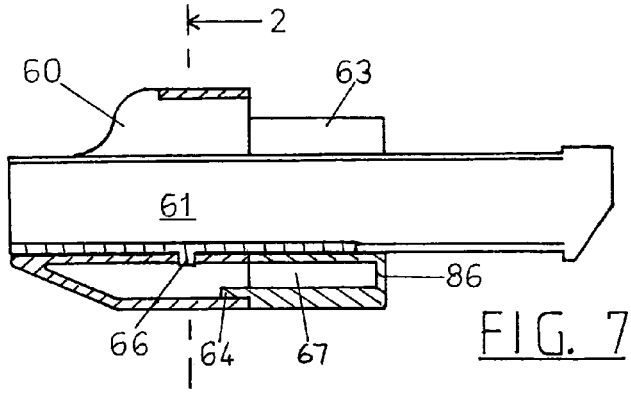
FIG. 7 is a cross-sectional view of the semi-tubular limiter of FIG. 1. Shown secured on the limiter are the container 60 and the lid 63. Lid 63 has been fully connected to container 60 in this drawing so that just sufficient space remains on the limiter for a whole number of elements 65*s* to be rotatably confined at the external end of lid 63.

With reference to FIG. 7, lid 63 has an interior wall and an exterior wall which in combination with the interior wall and exterior wall of container 60 will form a housing. Said housing defines a storage space 180 which includes cavity 67. At the closed end of lid 63, a flat wall 86 closes off the storage space and externally cooperates with lips 69, 70 to delimit the space for elements 65*s* on the limiter. At the other end of lid 63, a curved lip 64 protrudes into cavity 67 to bind container 60 and lid 63 together.

With reference to FIG. 1, along most of its length lid 63 defines a gap 68 generally subtending 90 degrees in a plane orthogonal to the axis of rotation. Lip 64 adds to the length of 63 and subtends less than 270 degrees so that gap 68 is wider at lip 64 than it is elsewhere. Inside cavity 67, lip 64 serves to rotationally limit lid 63 relative to container 60, through its confinement by said flat walls 73, 74.

Lid 63 is formed from a resilient plastic and may be squeezed to slightly reduce the size of gap 68. When held squeezed thus, lip 64 slides easily into the cavity 67 defined by container 60. Upon releasing the pressure on 63, the user will find that lip 64 forcefully abuts with the inside of exterior wall 71. The force of friction then stops lid 63 from moving longitudinally along 61 to inadvertently obstruct the rotation of elements 65. This is due to boss 66 which, as shown more particularly in FIG. 7, securely locates container 60 longitudinally of the axis relative to 61.

In order to facilitate the mounting (and later demounting) of lid 63, the lip 64 may be reduced at the extremity of its first insertion into the cavity 67. From there it may embody a gradual widening so as to rotationally limit lid 63 more and more as the lid is brought to its resting place against container 60. At its final place of rest, ready for the mounting of elements 65*s* at its end, any rotational latitude for 63 relative to 60 should be minimal. Thus lid 63 and container 60 are designed to present an integrated structure which the user may hold in one hand when rotationally manipulating elements 65*s* on the limiter.

Figure 5:
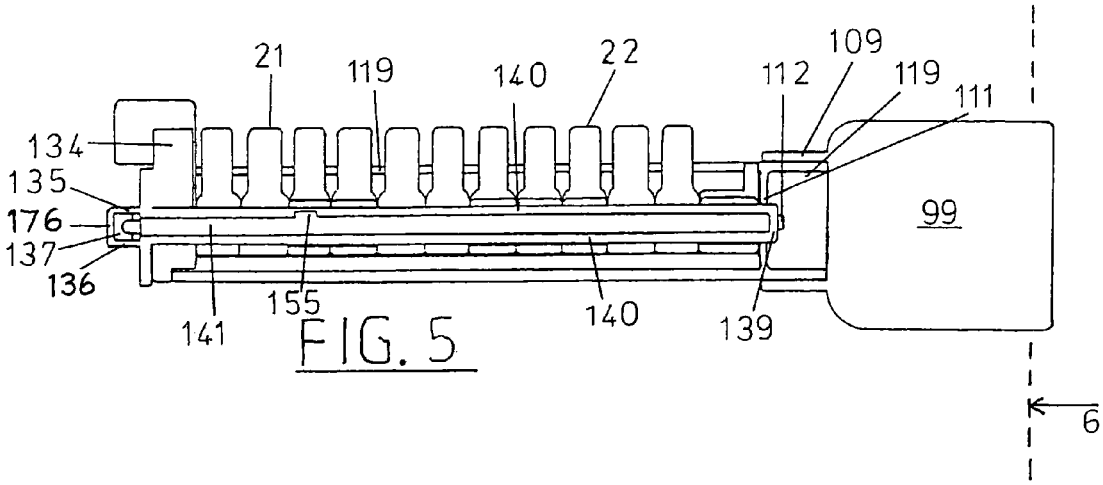
FIG. 5 is a plan view of a core in accordance with the invention including a detachable handle 99.

Said first apparatus includes a handle 99 which may be turned relative to said integrated structure in order to provide sixty degree rotation of a selected subset of the elements 65*s*. With reference to FIG. 5, torque may be transmitted from handle 99 to selected elements 65*s* through semi-cylindrical long member 119 (shown with its concavity facing out of the page) and projectional units, such as unit 21 for example, which have been rotationally locked to 119 in the assembly of a core for the puzzle. The invention may include means of attachment of handle 99 to long member 119 whereby 99 may be released from 119 and temporarily deployed at the opposite end of the core. Such means may include a semi-cylindrical holder 109 with the interior radius of 109 matching the exterior radius of the curvature of 119 about the axis. Member 119 may be forced against 109 by another part of the handle as would be clear to those skilled in the art.

Figure 4:
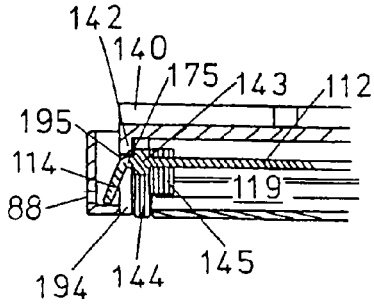

With reference to FIG. 4, spindle 112 is molded to bead 143 as if to extend through a hole in the bead and, when emerging from the bead, spindle 112 forms a resilient bent portion 114 including the bend 195 proximate to the bead. Between bead 143 and bend 195, the spindle includes a small shoulder 175 whereupon the second long member 140 is stopped with its end flange 142 abutting said shoulder.

The spindle 112 is molded as a separate component, including bead 143, shoulder 175 and bent portion 114, and the user may separate 112 from the other components of the core, whereas in the prior art device the central spindle was a fixed part of the semi-cylindrical long member (elsewhere referred to as the first member).

With reference to FIG. 5, grooved long member 140 (elsewhere referred to as the second member) defines groove 141 adapted to slidably locate the ridge 62 of the semi-tubular limiter. At the end opposite catch part 137, member 140 has a flange 139 which defines a hole for spindle 112.

During assembly of the core, the spindle 112 is inserted first through bearing means 144, 145 attached to semi-cylindrical long member 119 at the end opposite handle 99. The bearing means 144, 145 may be included with the same molding as member 119 and 145 defines a hole for spindle 112 which closely fits the spindle without preventing rotation of the spindle relative to 119. (Refer FIGS. 3 and 4 to identify said bearing means.)

Figure 3:
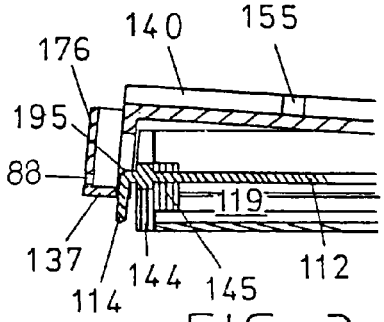
FIGS. 3 and 4 are cross-sectional views showing a catch part 137 at one end of the core of said first apparatus.

The arrangement for rotatably holding the spindle 112 at the end shown in FIGS. 3 and 4 may also include said bearing means 144, 145 in a separate molding from long member 119 and such is the arrangement more particularly shown in the drawings. In this case, bearing means 144, 145 should be glued or welded to 119 at manufacture. Part 145 comprises a lump attached to the concavity of 119 at the end thereof and part 144, molded with 145, extends the bearing means beyond the end of said concavity. Part 145 defines the hole for spindle 112 and when the spindle is fully inserted bead 143 rests rotatably against 145 while part 144 accommodates the bead. The bead is accommodated so that it and part 144 extend the same distance longitudinally of the axis away from part 145 and thus together they provide a surface of abutment for flange 142 of member 140. By means of this abutment and, at the other end, the abutment of flanges 111 and 139 (refer FIG. 5), the long member 140 and the long member 119 are held in mutual engagement longitudinally of the axis.

With reference to FIG. 5, after inserting the spindle 112 through said bearing means, the user may mount projectional units on the spindle one by one, bringing some of them into rotational engagement with long member 119 and others into rotational engagement with long member 140. Spindle 112 is then inserted through a hole defined by flange 111 which flange may also be included in the same plastic molding as member 119. Thus holes in 145 and 111 define positions for spindle 112 at the ends of the pattern of projectional units assembled in the core. These positions are defined in relation to member 119 to facilitate rotation of member 119 about the longitudinal axis of the spindle 112. Thus when an assembled puzzle core is put into the limiter and its cargo, the axis of rotation for elements 65*s* on the limiter will approximately coincide with the longitudinal axis of spindle 112 as the exterior surface of 119 rotatably abuts with the interior surface of limiter 61.

The projectional units of the core, being identical with those of the prior art device, each define an axial orifice. During the user's assembly of a puzzle core, after spindle 112 has been inserted through the axial orifice of each projectional unit, spindle 112 is finally inserted through a hole in said flange 139 possessed by long member 140. Here member 140 rotatably abuts with flange 111 of member 119. Then member 140 is brought down upon the shoulder 175 of spindle 112 at the other end of the core as the member engages some of the projectional units, for example unit 22. With reference to FIG. 3, the catch part 137 of member 140 then engages 114, forcing the spindle to bend further at bend 195. Catch part 137 is pushed over spindle portion 114, finally releasing it. When 114 resiles, it moves into an enclosure defined by 137 (bottom), side walls 136, 135 and end wall 176 of the long member 140. It is trapped in there, as shown particularly in FIG. 4, until such time as it may again be forced aside from 137. Walls 135 and 136 are parallel projections off flange 142. They run parallel to the axis and are joined by end wall 176. Thus catch part 137 is a partial bottom for the well defined by 135, 136, 142 and 176. End wall 176 defines hole 88 proximate the end of 114 so that force may be applied to 114 by the insertion of a rigid rod or protuberance through 88.

The cross-section of FIG. 4 is taken in a plane which includes said axis. Thus it may be seen that catch part 137 and flange 142 define an opening 194 which extends radially away from shoulder 175. This opening should be large enough to contain 114. Whereas 114 may be forced into the opening by pressing its end towards 144, the opening will not ordinarily contain 114. In its resting position as shown in FIG. 4, 114 will make a lesser angle to said axis than it must when forced to occupy said opening. Indeed the occupation of said opening by 114 will allow catch part 137 to move past 114.

With reference to FIG. 5, member 119 extends beyond said abutting flanges 139, 111, longitudinally of the axis, to lodge frictionally in a recess defined by handle 99. When 99 and 119 are lodged together for normal puzzle operation they form an integrated whole assisted by the bonding force of friction to transmit torque from the user's hand. Torque is applied by the user between handle 99 and the housing formed at least by container 60 and, if it is present, by lid 63. Such torque may cause rotation of one element 65 relative to another if the two elements 65*s* are suitably positioned longitudinally of the axis relative to the pattern of projectional units in the core. Each unit holds a barrier pointing away from said axis so that an element 65 when positioned over the unit will be rotationally limited by the barrier. Such an element may be forced to rotate on the limiter if the unit underneath is rotationally engaged with member 119 rather than member 140.

In manipulating the prior art device, a user would position the core longitudinally of the axis relative to the annular indicator elements by holding the indicator with fingers of both hands and selectively applying pressure to the ends of the core with the palms of the hands. Then the rotation, through sixty degrees, of one subset of the elements in relation to its complementary subset would be achieved through the direct application of torque to the elements. This mode of operation gave the prior art device a similarity to other puzzle devices that were popular in the market.

By contrast, according to the present invention, torque is not applied directly to the annular elements. Moreover, in use of the first illustrative embodiment, since the user holds handle 99 in one hand, and said housing in the other hand, for rotating one subset of elements 65*s* relative to its complementary subset, it is natural that longitudinal repositioning of the elements should be achieved through the pushing or pulling of handle 99 in relation to said housing. This mode of operation also informs the construction of the second illustrative embodiment of the invention and is the generally preferred mode because of its association with the possibilities of dramatic expression occuring when the elements 65*s* have been so positioned that their large keyways 96*s* are aligned with the delayer means 134. In accordance with the known art, such alignment permits the withdrawal of the core from the limiter.

Figure 6:
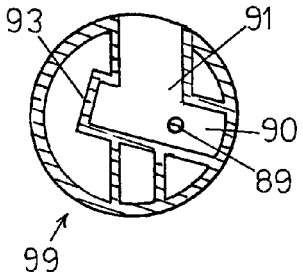
FIG. 6 is a cross-sectional view of the handle 99 showing protuberance 89 which is adapted to engage bent spindle portion 114 when the handle is deployed to release the fastening device.

With reference to FIG. 6, handle 99 may define a recess 90 adapted to accommodate the structure of walls 135, 136, 137 and 176 at one end of long member 140. Handle 99 comprises an outer wall which forms the user's grip surface and a flat interior web wall 91 normal to the geometrical axis of the cylinder (this axis is also the axis of spindle 112 when the handle 99 is attached to 119). The interior web wall creates a forward compartment in which two concentric annular walls (one being said outer wall) define an annular gap therebetween for the frictional lodgement of semi-cylindrical long member 119. This forward compartment is not shown in detail but the web wall also creates a rear compartment in which, as shown in FIG. 6, a wall 93 perpendicular to the web wall defines the recess 90. Inside recess 90, also protruding from the web wall at ninety degrees, a slender protuberance 89 is firmly mounted. It is envisaged that 89 would be part of the same plastic molding as the other parts of handle 99.

With reference to FIG. 6, recess 90 is so shaped by wall 93 that it will accommodate the end of the long member 140 only when that member is oriented in a way that brings protuberance 89 and hole 88 (refer FIGS. 3 and 4) into close proximity. This facilitates the user to insert protuberance 89 into 88 and apply force to spindle portion 114. When 114 has been moved clear of 137, protuberance 89 may be withdrawn and the long member 140 may be drawn away.

Spindle 112 may then be withdrawn, releasing the projectional units and allowing a different puzzle configuration to be embodied.

Figure 9:
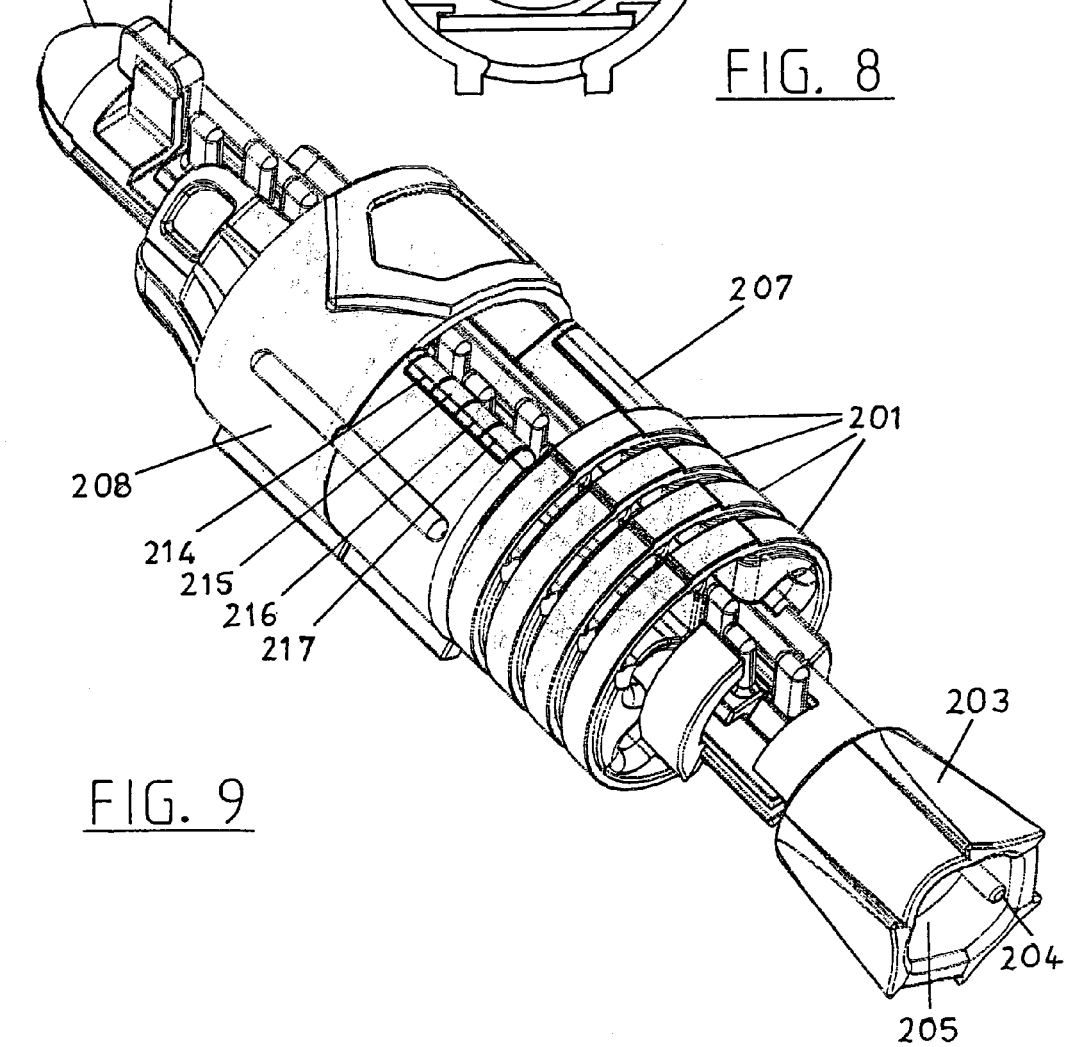
FIG. 9 is a pictorial view of a complete apparatus in accordance with the invention. The apparatus is shown here in its solution state wherein the core may be directly slid out of the limiter without further rotation of annular elements on the limiter.
Figure 10:
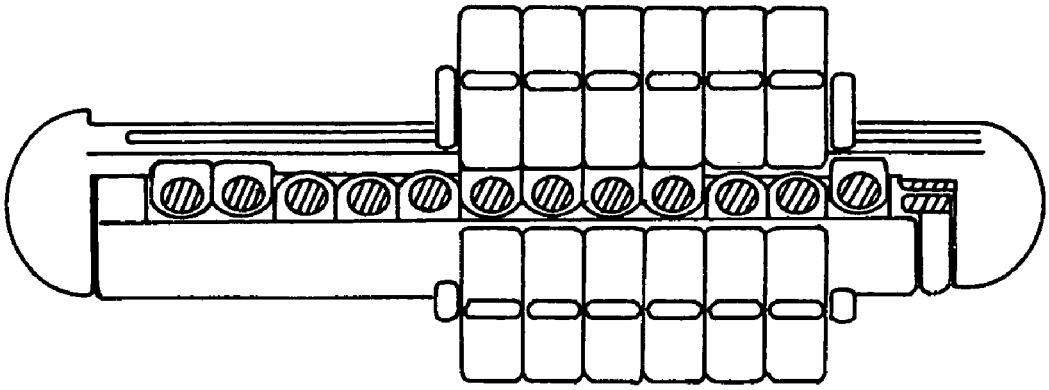
FIG. 10 PRIOR ART
FIG. 10 is a view of the prior art apparatus. The core in this apparatus readily falls apart when it is withdrawn.

With reference to FIG. 9, said second apparatus is constructed broadly the same way as said first apparatus. Whereas each annular element 201 defines one large keyway and five smaller ones, in the puzzle solution state as shown in the drawing, each element 201 has been positioned on the limiter so that its large keyway is lined up with the obtruding delayer means 202 at the catch end of the core. In this state, by pulling handle 203 in relation to the container 208 and lid 207, the core may be slid out of the limiter.

Figure 8:
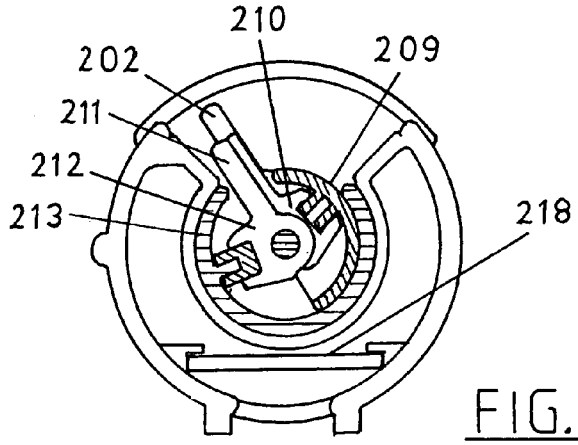
FIG. 8 is a cross-sectional view of the apparatus of FIG. 9, showing a lid 207 which differs in its construction from the lid of said first apparatus. The plane of the cross-section separates lid 207 from the adjacent annular element 201.

With reference to FIG. 8, in accordance with the known art, the limiter 213 rotatably abuts with the convex outer surface of semi-cylindrical long member 209. This allows torque applied to the limiter to effect a rotation of projectional unit 212 in relation to projectional unit 210 through a maximum of 60 degrees just.

Each projectional unit provides a barrier, for example barrier 211, adapted to extend into a keyway defined by an element 201. In one state of the core, as depicted in FIGS. 8 and 9, the barriers are approximately aligned with delayer means 202 and the elements 201*s* may then be readily displaced longitudinally of the axis in relation to the barriers. Similar longitudinal displacement of the elements 201*s* is facilitated after limiter 213 has been rotated to the maximum extent possible on member 209.

With further reference to FIG. 9, but broadly in description of the invention, it may be appreciated that the core is wand-like, a quality rendered by the use of a handle (e.g. handle 203) which extends the first long member, longitudinally of the axis of rotation, substantially beyond the point where the second member is pivoted at the end opposite the delayer means. The wand-like quality is also dependent upon a fastening device to keep the projectional units in the core when the core has been withdrawn from the limiter. Whereas a wand-like core invites its own waving around after its withdrawal from the limiter, in the current invention the core acquires further significance as a means of gesturing. It may be held by handle 203 and pointed in the air, after its withdrawal from the limiter, as an expression of triumph.

With reference to FIG. 8, a game in accordance with the invention may be enhanced by the specification of a curriculum of puzzles. Said curriculum may suitably contain a dozen or more puzzles specified in reference to the sequence of projectional units of the puzzle core, each specification determining, for each projectional unit, whether it is rotationally engaged to limiter 213 or alternatively to long member 209. The game may then involve an adopting or a modifying of this curriculum by the players followed by a series of rounds or sub-games in each of which a puzzle is assembled by one of the players and solved by the other. A rigid incentive, such as a coin 218, may be inserted by the player assembling the puzzle and later retrieved by the player solving it. Depending on whether lid 207 is deployed or not, coin 218 may be held either in lid 207 or in container 208, in either case being retrievable through the opening exposed when elements 201*s* are demounted from the limiter 213, but otherwise being locked inside the puzzle. Tabs may be provided to hold coin 218 in a fixed position and the lid or the container thereby holding the coin may define a viewing aperture whereby the presence of the coin may be ascertained before the puzzle is solved.

If the puzzle apparatus has four annular elements and sixteen projectional units like, for example, the apparatus of FIGS. 8 and 9, a time limit of the order of 60 seconds or thereabouts may allow sufficient wins in sufficiently many cases, as between adults and older children. Timing would begin upon the handover of the assembled and randomised apparatus. In this context, the withdrawal of the core from the limiter would signal completion of the timed action and a gesturing with the core could be an accompaniment to this completion, assuming completion to have been achieved within the accepted time limit.

In the apparatus of FIGS. 8 and 9, the end wall 206 has a rounded external aspect to give the assembled apparatus, as a whole, a rocket-like appearance. Correspondingly the handle defines a circular recess 205 adapted to accept 206 when the handle is removed for deployment as a release means in accordance with the proceedure outlined for the apparatus of FIGS. 3 and 4. In the case of the apparatus of FIG. 9, the proceedure also involves aligning protuberance 204 in the handle so that it may penetrate the hole in end wall 206.

End wall 206 corresponds with end wall 176 in the first illustrative embodiment but overhangs the well for the bent spindle portion rather than merely delimiting it. In the apparatus of FIGS. 8 and 9, the end wall is given an aesthetic function and the rounded external aspect has no particular mechanical significance.

Congruent annular elements are preferred and have been employed in both of the apparatuses depicted. Where congruent annular elements are employed, they are preferably supplied in a single colour whereas colour differences between them would frustrate the educational value of using colour to identify the elements once mounted. For the purposes of discussing puzzle solutions, it is essential to identify the annular elements by their ordinal position proceeding along their common axis of rotation. To this end, reference FIG. 9, the coloured markers 214, 215, 216 and 217 have been included in said second apparatus as separately molded pieces which are attached to the lid 207 at the time of manufacture, after molding. Preferably each marker is a different colour and each colour stands out from the background colour of the lid.

The foregoing description outlines the preferred manners of constructing the invention, with the possible exception that transparent outer walls for container 208 and lid 207, or container 60 and lid 63, would in some circumstances be preferred to opaque walls. This would facilitate easier viewing of any incentive held inside. In addition it is preferred to accommodate sixteen only projectional units in the puzzle core, each unit having the same extent longitudinal of the axis as each rotatable annular element on the limiter. Some modifications to these preferred arrangements are briefly described in what follows.

With reference to FIGS. 3 and 5, the second member 140 of said first apparatus defines a notch 155 communicating with groove 141. This notch has no function in the apparatus as depicted. However in an envisaged modification of the invention, ridge 62 of the semi-tubular limiter may include a moveable arm having an end adapted to lodge in said notch and, after being so lodged, adapted to move out of said notch when the core, including member 140, is moved with a certain force longitudinally of the axis relative to the limiter and said arm. By means of such notches, a series of stations may be defined for the limiter, in each of which stations each element 201 will be rotationally limited by a single one only of the rigid barriers such as barrier 211.

In a further modification of the invention, a game is played between two players being a type of hide-and-seek wherein one player hides a precious object and draws a map for the other player showing the whereabouts of the hidden object. However the map is not shown directly to the other player but cut into portions. Each portion in turn is secured in the storage space defined by the housing on the limiter and then the apparatus is randomised before it is passed to said other player. Thus said other player must retrieve each portion of the map by solving a puzzle constructed by the first player. When the entire map has been retrieved and the hidden object has been found by said other player, the roles may be reversed. Players may keep records of their successes and may follow a curriculum in determining how to assemble the core of the apparatus.

These and further modifications may be incorporated without departing from the scope of the invention as hereinafter claimed.

What is claimed is:

1. A manipulative puzzle which comprises a first member and a second member pivoted for rotation in relation to said first member about an axis, which comprises a set of annular elements, each element defining a bore and defining a keyway at the periphery of the bore, which comprises a semi-tubular limiter, and which displays a form in which said limiter coaxially pins said elements on an equable arbor for rotation about said axis, in which said first member and said second member are mutually engaged longitudinally of said axis, in which said limiter is engaged with said second member for simultaneous rotation therewith relative to said first member, in which said limiter is slidable in relation to said second member whereby said elements may be moved, in which certain rotations of said second member relative to said first member permit respective rotations of an exclusive lot of said elements, the make-up of which lot is variable by movements of said elements longitudinally of said axis in relation to said first and second members, whereas said limiter joins a housing delimiting a storage space at one end of said arbor, said housing including a detachable lid which closes off said storage space, and whereas depending on the deconstruction of said form by the withdrawal of said members from said bore, said limiter permits the unpinning of said elements through the application of controlled manipulative forces , thereby providing a way of detaching said lid and gaining manipulative access to the contents if any of said storage space.

2. A manipulative puzzle as set forth in claim 1 including an object releaseably held in said storage space, as means for the playing of a game wherein the release of said object via the deconstruction of said form is one player's partial aim.

3. A manipulative puzzle as set forth in claim 2 together with marks of representation confined longitudinally of said axis in relation to each other, said marks forming indicia as a sequence in order longitudinally of said axis and said marks being equal in number to said elements so that each mark corresponds to one of said elements according to that element's ordinal position longitudinal of said axis, said marks serving to facilitate a reference to said elements independent of the elements' own colouring and indicia, whereas said elements' relative order longitudinally of said axis may be varied after the deconstruction of said form.

4. A manipulative puzzle as set forth in claim 1 which comprises a sequence of projectional units in line longitudinally of said axis, each unit engaged to one of said first and second members for rotation relative to the other one of said first and second members about said axis, which comprises a plastic molding having a resilient bent portion, wherein said second member incorporates a catch part at one end of said sequence, whereas variations in the disposition of said catch part may be produced by movements at said bent portion, there being one disposition thereby achievable through the application of manipulative force wherein said catch part may passed over said bent portion and thereby said first and second members may be disjoined.

5. A manipulative puzzle as set forth in claim 4 whereas the reconstruction of said form may redeploy said bent portion, said catch part further bending said bent portion and, as said bent portion resiles, trapping said bent portion to relatively confine said first and second members and said projectional units.

6. A manipulative puzzle as set forth in claim 5 wherein said molding is a spindle, said projectional units being mounted on said spindle and one of said projectional units being rotatable on said spindle.

7. A manipulative puzzle as set forth in claim 6 which comprises a handle detachably joined to said first member, said handle mounting a device to facilitate the application of force to said bent portion of said spindle whereby said first and second members may be disjoined.

8. A manipulative puzzle as set forth in claim 1 wherein said housing comprises a container in addition to said lid, said container being joined to said limiter for simultaneous rotation with said limiter relative to said first member, and wherein said lid comprises a means of attachment to said container, whereas said means of attachment is deployed in said form to rotationally engage said lid with said container for simultaneous rotation of the lid and container in relation to said first member.

9. A manipulative puzzle as set forth in claim 8 wherein said lid is also a spacer, reducing the number of said elements which may be accommodated on said limiter, whereas after the deconstruction of said form and the unpinning of said elements, said lid may be detached and said form may be reconstructed with increase of said number, additional elements then replacing said lid on said limiter.

10. A manipulative puzzle as set forth in claim 7 whereas said second member defines a groove, and whereas, given said form, said limiter incorporates a ridge slidably located in said groove whereby said second member may be rotated through the application of torque between said limiter and said handle.

* * * * *